US012685388B2

(12) United States Patent
Ryan

(10) Patent No.: US 12,685,388 B2
(45) Date of Patent: Jul. 21, 2026

(54) GAME TABLE

(71) Applicant: Pongo World Pty Ltd, Preston (AU)

(72) Inventor: Jack Ryan, Preston (AU)

(73) Assignee: Pongo World Pty Ltd, Preston (AU)

( * ) Notice: Subject to any disclaimer, the term of this patent is extended or adjusted under 35 U.S.C. 154(b) by 1028 days.

(21) Appl. No.: 17/749,080

(22) Filed: May 19, 2022

(65) Prior Publication Data

US 2022/0369808 A1 Nov. 24, 2022

(51) Int. Cl.
*A47B 25/00* (2006.01)
*A63B 67/04* (2006.01)

(52) U.S. Cl.
CPC ..... *A47B 25/003* (2013.01); *A63B 67/04* (2013.01)

(58) Field of Classification Search
CPC ... A47B 25/003; A63B 67/04; A63B 71/0045; A63B 67/002
See application file for complete search history.

(56) References Cited

U.S. PATENT DOCUMENTS 5,632,386 A * 5/1997 Gabhart ..... A63B 47/00 D6/552

FOREIGN PATENT DOCUMENTS

AT 356551 B * 5/1980 ..... A47B 25/003
CN 202160915 U * 3/2012
CN 108325188 A * 7/2018 ..... A47B 25/003

OTHER PUBLICATIONS

AT 356551 Translated (Year: 1980).*
CN 108325188 Translaated (Year: 2018).*
CN 202160915 Translated (Year: 2012).*

* cited by examiner

*Primary Examiner* — Jeffrey S Vanderveen
(74) *Attorney, Agent, or Firm* — Bochner PLLC; Andrew D. Bochner

(57) ABSTRACT

The present invention relates to a table for playing games. The table may include at least one panel of aluminum composite material to form a playing surface with a frame member to support it. The frame member may extend around the perimeter of the playing surface to brace the aluminum composite panel. A first panel of the aluminum composite material may be treated with a tactile coating to form a layer over its' surface to increase its' friction coefficient.

5 Claims, 4 Drawing Sheets

GAME TABLE

FIELD OF INVENTION

The present invention relates generally to a table for playing games upon, and in particular, to a table for playing ball games, such as table tennis or ping pong.

BACKGROUND OF THE INVENTION

Table tennis or ping pong is a popular sport played by individuals of all ages and nationalities. The game is played upon a table where players are positioned at opposing ends of the table and are required to hit a specially designed ball such that the ball bounces in an opposing half of the table where it is to be returned by the other player. Points are awarded to a player that "beats" their opponent by either hitting the ball such that it is missed by the other player or by the other player failing to hit the ball back into play.

Table tennis tables are typically made from a wood material, such as a plywood, that has a thickness of between 12 mm-30 mm to provide a consistent bounce. Such plywood tables are typically painted with an alkyd paint to provide a degree of friction resistance to the ball to replicate consistent bounce and ball speed. For this reason, most table tennis tables have a generic green or blue colour surface and are limited in the type of designs and applications that may be applied to the surfaces thereof.

Whilst plywood tables operate well in indoor environments, the wood material is not suitable for outdoor use as it will warp and deteriorate when in contact with moisture and heat. To provide outdoor tables, plastic materials have been used to form the tables but such tables have been show to warp in hot conditions which can adversely effect the bounce of the ball. Metal tables, in the form of steel, have also been used in outdoor environments, but such tables are particularly heavy and cumbersome. Both plastic and steel tables also perform poorly in relation to gameplay, as they have inconsistent ball bounce and do not resemble gameplay of a conventional plywood table.

Thus, there is a need to provide a gaming table that is able to be used in all weather conditions and which provides a realistic gameplay that resembles the gameplay of conventional indoor tables.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

SUMMARY OF THE INVENTION

Accordingly, in one aspect of the invention there is provided a table for playing games comprising:

- at least one panel of aluminium composite material configured to form a playing surface;
- a frame member for supporting the at least one panel of aluminium composite material, the frame member configured to extend around a perimeter of the playing surface to brace the at least one panel of aluminium composite material;
- wherein the at least one panel of aluminium composite material is treated with a tactile coating to form a layer over the surface of the at least one panel of aluminium composite material to increase a coefficient of friction thereof.

In one embodiment, the at least one panel of aluminium composite material is printed with an image and the tactile coating functions to protect the image from exposure to weather.

The at least one panel of aluminium composite material may be treated with at least two layers of the tactile coating.

The table may be a table tennis table and the tactile coating increases the coefficient of friction between the playing surface and the ball.

The table may further comprise a utility holder mountable with respect to the frame member to hold one or more items of equipment.

BRIEF DESCRIPTION OF THE DRAWINGS

The invention may be better understood from the following non-limiting description of preferred embodiments, in which.

DETAILED DESCRIPTION OF AN EMBODIMENT OF THE INVENTION

The present invention will be described below in relation to its application for use as a table tennis table. However, it will be appreciated that the table of the present invention could be used for a variety of other games, such as shuffle boards and corn hole boards, as an example.

Figure 1:
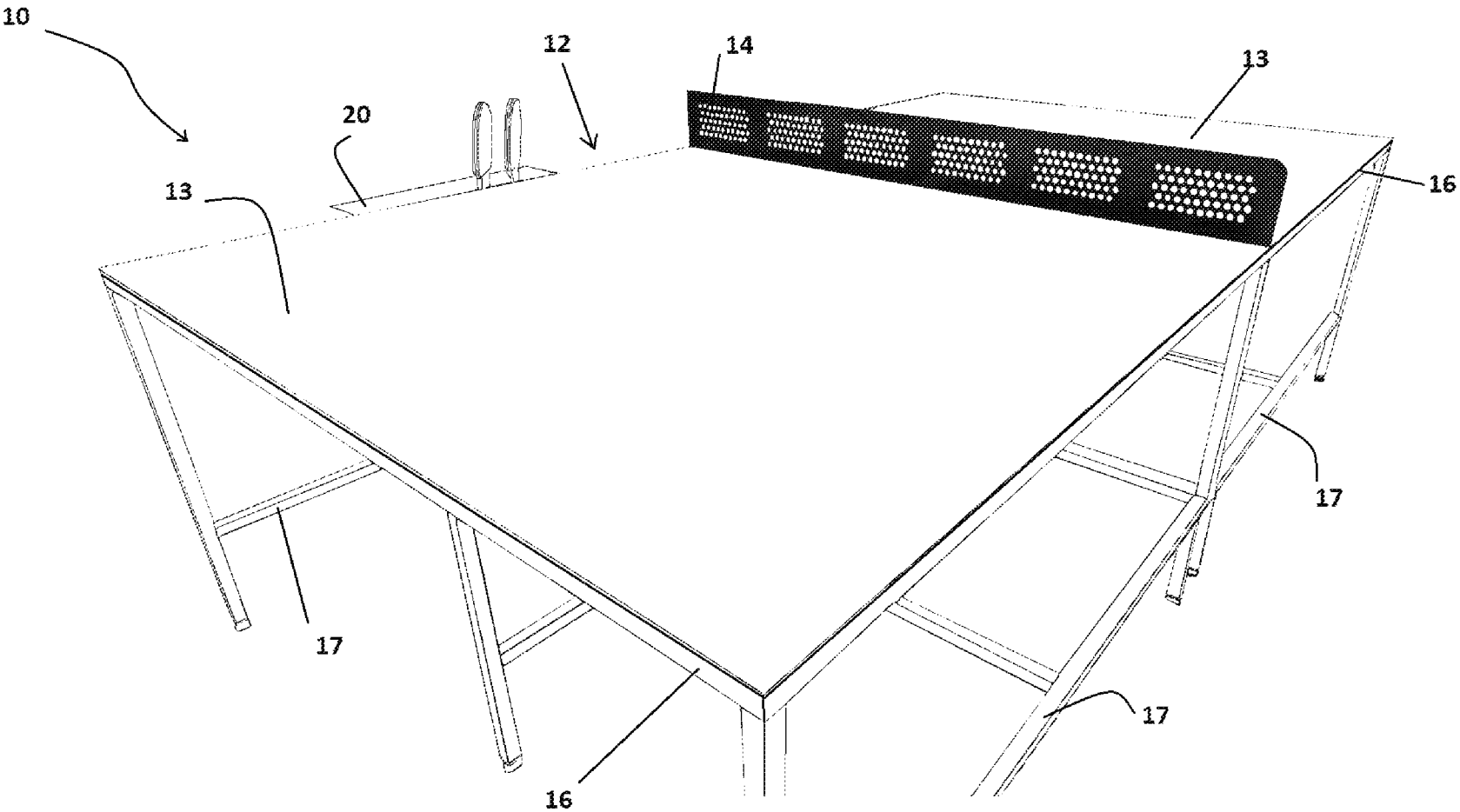
FIG. 1 is perspective view of a gaming table in accordance with an embodiment of the present invention.
Figure 2:
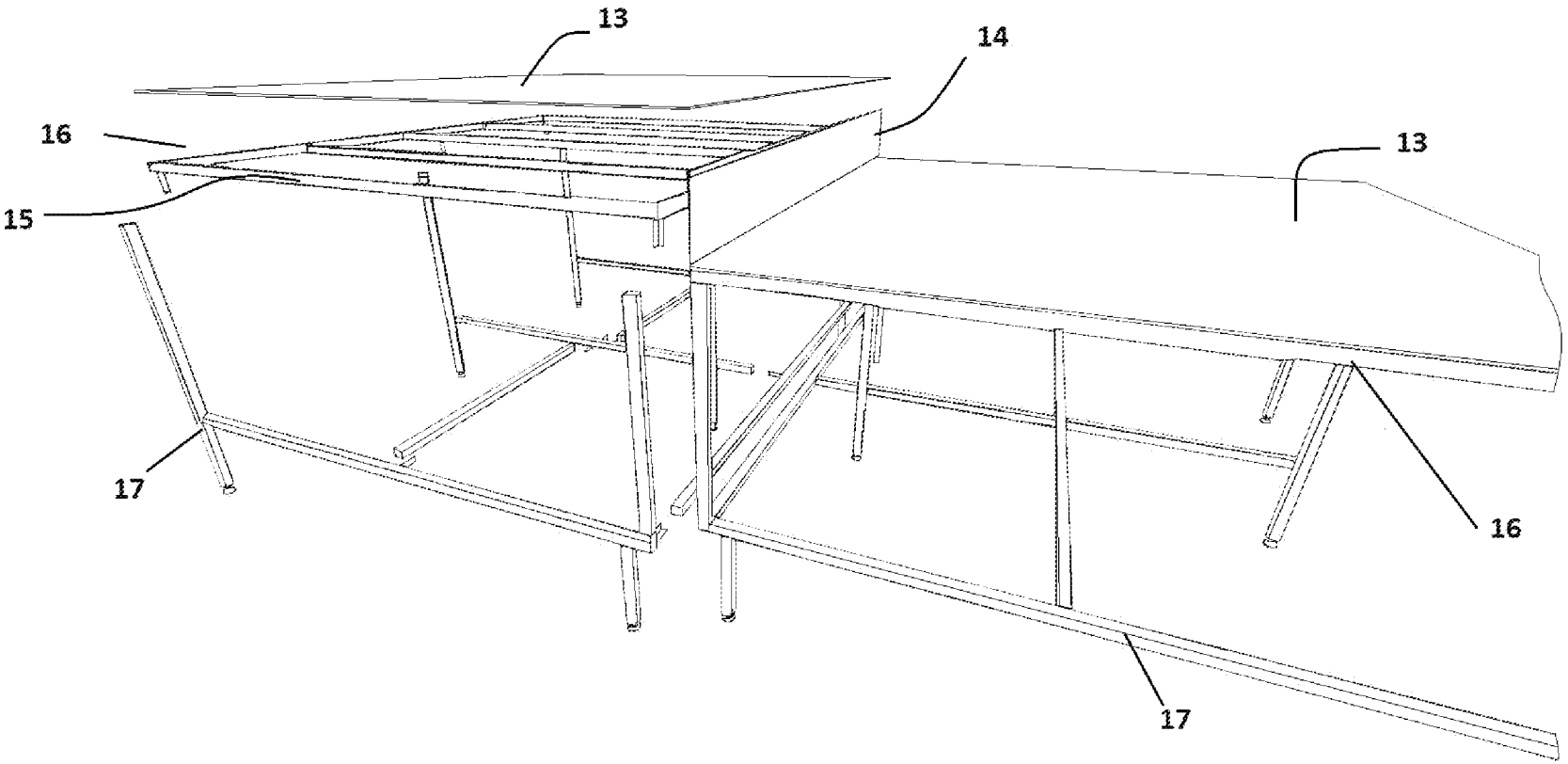
FIG. 2 is a partially exploded view of the gaming table of FIG. 1.
Figure 3:
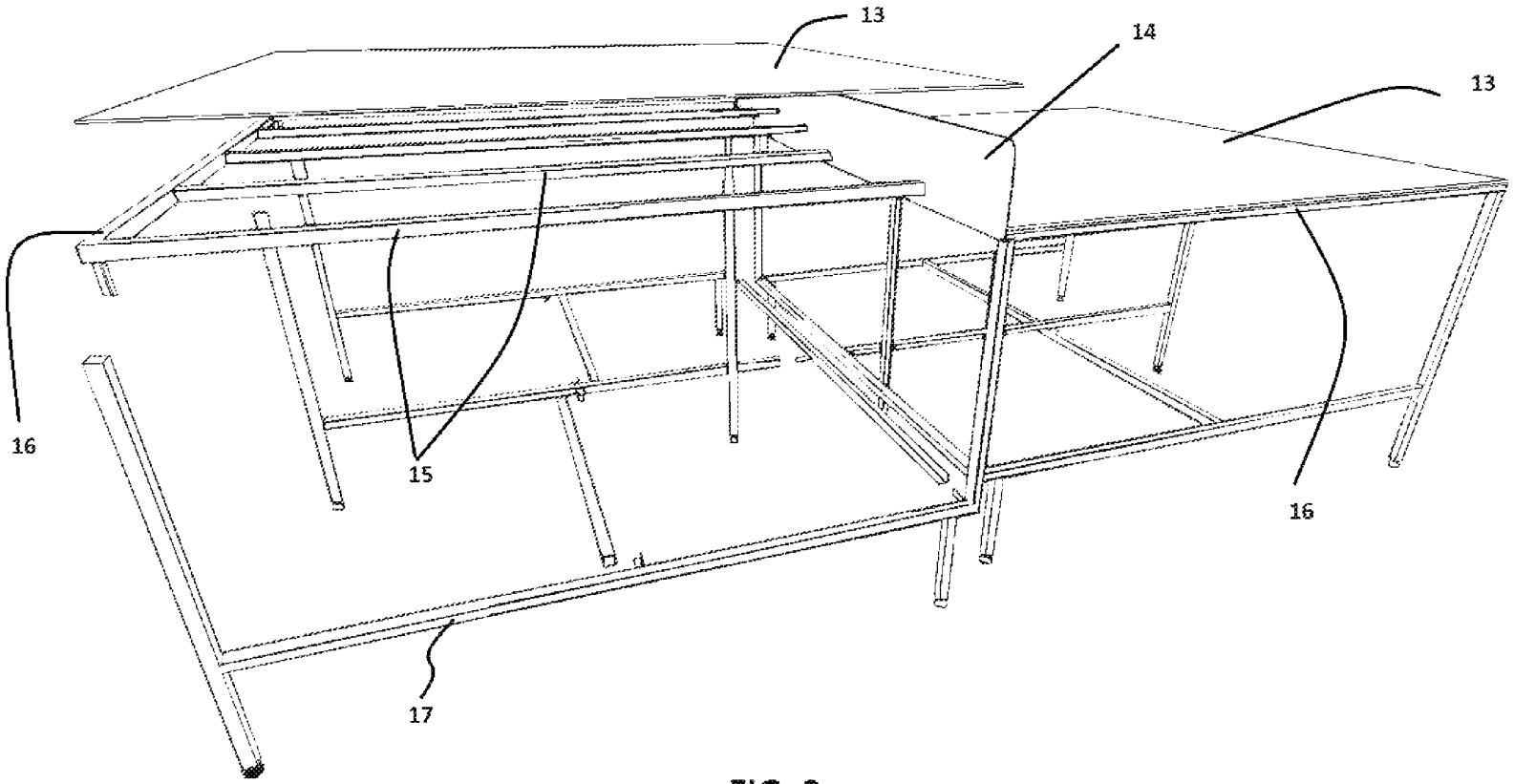
FIG. 3 is an alternative partially exploded view of the gaming table of FIG. 1.

Referring to FIG. 1, a table 10 in accordance with an embodiment of the present invention is depicted. The table 10 is configured to be suitable for installation in an outdoor environment, where the table 10 is exposed to sunshine and rain.

The table 10 comprises a playing surface 12 made up of one or more board members 13 shaped to define the playing surface 12. In a preferred embodiment, the one or more boards 13 are made from an aluminium composite material (ACM), such as boards commonly used in signage. The boards 13 are in the form of a rigid sheet of material comprising two sheets of aluminium bonded to a polyethylene core. A surface of one of the aluminium sheets may be prefinished to receive a printed image thereon, as discussed in more detail below. Two boards 13 may be cut to a predetermined size to accommodate half of the playing surface each, such that the boards 13 can be arranged in abutting fashion as shown, to form the playing surface 12. A net member 14 may be positioned between the boards 13 to complete the playing surface 12 as shown. The net member may be made from a metal, such as stainless steel or coated aluminium to be weather resistant As the external sheets of the boards 13 are aluminium, the surface of the boards 13 can be printed through the use of a conventional flat bed printer, to apply any pattern or ornamentation to the surface of the boards as required. As such, the table 10 can be personalised by applying a logo or name upon the surface of the boards 13 or can be formed to resemble a tennis court, football field or soccer pitch. The board of the present invention allows for high-definition graphics to be printed directly onto the playing surface 12, rather than requiring a conventional vinyl print.

In a preferred embodiment, the ink applied to the surface of the board is UV stable to avoid premature fading of the image over time. The printed surface of the boards 13 are then applied with a preliminary adhesion coating followed by a satin surface coating of both matt and gloss, and also having a UV resistant property. The satin surface coating of both matt and gloss is a polyurethane based clear coat but not limited to a laminate film or wrap that forms a barrier against moisture ingress, protects against substrate deterioration, has high UV resistance and provides greater durability and colour retention to the surface of the boards 13. This coating also provides a degree of friction resistance to the surface of the boards 13 to provide a true ball bounce that resembles an indoor plywood table. A further surface coating of both matt and gloss may also be applied, with the further surface coating of both matt and gloss also reducing the reflective sun glare off the surface of the board 13 when playing in the direct sunlight.

To form the table 10, each of the boards 13 are mounted to a frame 16 that braces the underside of the board 13, as shown. In a preferred embodiment, the boards 13 are attached to the frame by way of an adhesive tape, such as a double-sided architectural metal tape, that is capable of withstanding all-weather conditions. The frame 16 supports the board 13 around the perimeter thereof and has struts 15 extending longitudinally in an equi-spaced manner to support the centre of the boards 13. Such a bracing of the boards 13 further ensures that the ball bounces in a true manner that replicates a conventional plywood table, with no dead bounce spots pots on the surface of the boards 13.

The frame 16 is supported on leg supports 17 that maintain the frame 16 and boards 13 at an elevated suitable for play. The leg supports 17 may be height adjustable to accommodate different outdoor environments as required and in some embodiments the legs may be foldable. All of the parts that form the frame 16 and leg supports 17 are preferably formed, folded, and moulded without welds to enhance the integrity of materials.

Figure 4:
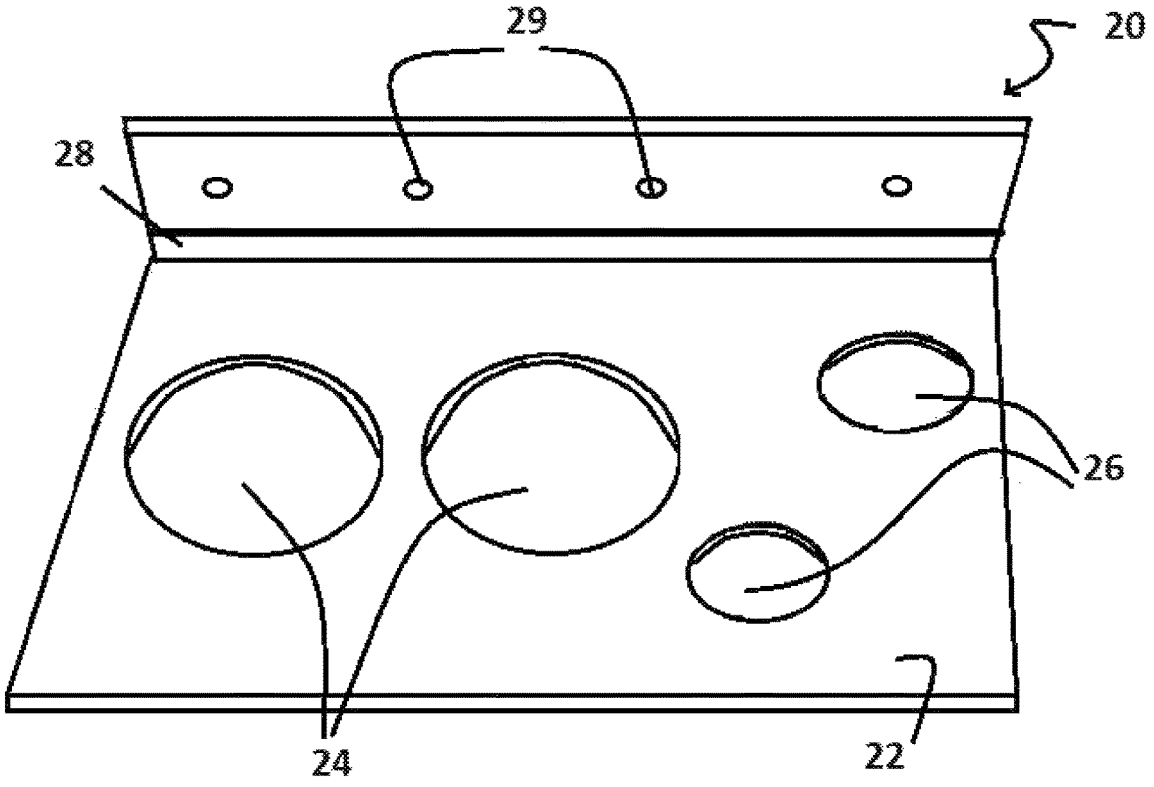
FIG. 4 is a top perspective view of a utility holder for use with the table of FIG. 1.
Figure 5:
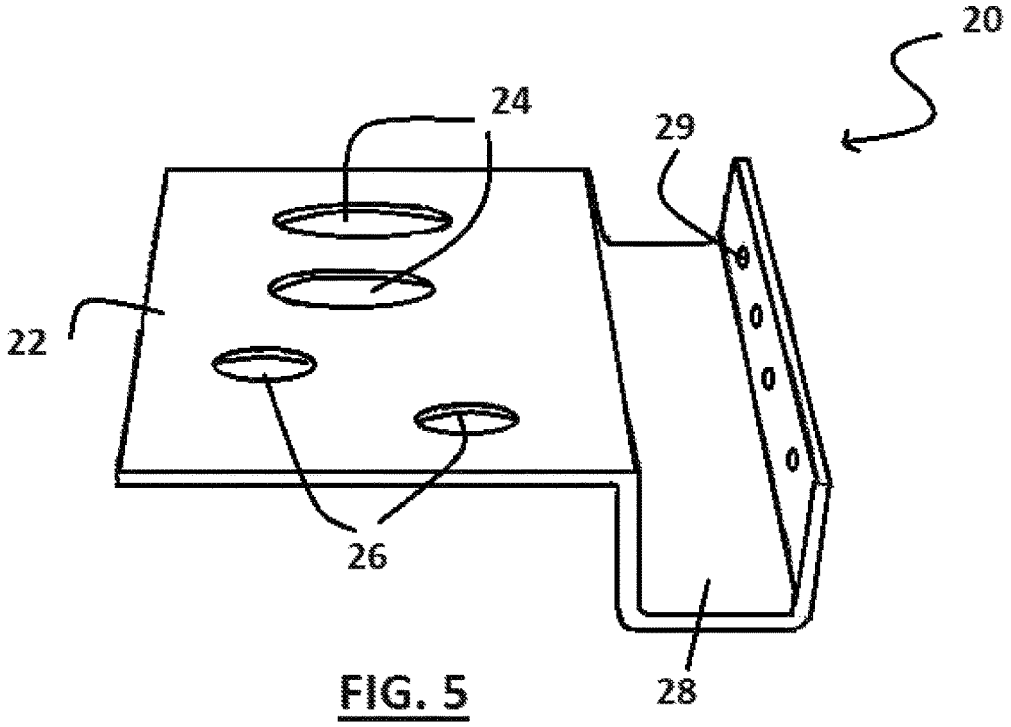
FIG. 5 is a side perspective view of the utility holder of FIG. 4.

As is shown in FIG. 1, the table 10 also comprises a utility holder 20 to hold bats and drinks as required. The utility holder 20 is shown in isolation in FIGS. 4 and 5 and comprises a plate member 22 having holes 24, 26 formed therein. The holes 24 and 26 being of different diameters such that the smaller diameter holes 26 are able to receive a handle of a bat whist the larger diameter holes 24 can receive a cup or similar drinking receptacle.

A channel member 28 is attached to a rear edge of the plate 22. The channel member 28 has a U-shaped configuration so as to be received around the frame 16 along an edge of a board 13 such that the plate 22 extends from the edge of the table 10 as show in FIG. 1. The channel member 28 has holes 29 formed therein to facilitate attachment to the frame 16 by way of crews or the like. Once attached to the frame 16, the utility holder 20 is able to be easily accessed by the players to store the playing bats and any drinks and the utility holder can be simply adapted to store other elements, such as balls or the like, as would be appreciated by those skilled in the art.

It will be appreciated that the table 10 of the present invention provides for a simple and effective playing table that can be used in either an indoor or an outdoor environment, in any weather conditions. The use of a treated aluminium composite material to form the playing surface ensures that the playing conditions and ball behaviour mimic that of a conventional plywood table and provides for a surface that can be printed to carry any variety of HD Graphics to provide unique and personal playing experience, without compromising the quality of the play.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the table uppermost.

It will be appreciated by those skilled in the art that many modifications and variations may be made to the methods of the invention described herein without departing from the spirit and scope of the invention.

The invention claimed is:

1. A table for playing games comprising:

at least one panel to form a playing surface of the table, the at least one panel comprising a pair of sheets of aluminium bonded to a polyethylene core;

a frame member for supporting the at least one panel in position, the frame member configured to extend around a perimeter of the playing surface and has one or more strut members extending in an equi-spaced longitudinal configuration with respect to the at least one panel to form a brace to support an underside of the at least one panel when positioned thereon;

wherein an upper surface of an uppermost sheet of aluminium of the at least one panel is treated with a tactile coating to form a layer over the upper surface of the uppermost sheet of aluminium to increase a coefficient of friction thereof.

2. A table according to claim 1, wherein the upper surface of the uppermost sheet of aluminium of the at least one panel is printed with an image and the tactile coating functions to protect the image from exposure to weather.

3. A table according to claim 1 or claim 2, wherein the upper surface of the uppermost sheet of aluminium of the at least one panel is treated with at least two layers of the tactile coating.

4. A table according to claim 1, wherein the table is a table tennis table and the tactile coating increases the coefficient of friction between the playing surface and the ball.

5. A table according to any one of the proceeding claims, further comprising a utility holder mountable with respect to the frame member to hold one or more items of equipment.

* * * * *